United States Patent [19]

Sheffer

[11] Patent Number: 4,632,040

[45] Date of Patent: Dec. 30, 1986

[54] EXECUTIVE DESK WITH LOCKING FLAPS

[75] Inventor: Phil B. Sheffer, New Oxford, Pa.

[73] Assignee: Merchandising Innovations, Inc., Hanover, Pa.

[21] Appl. No.: 822,791

[22] Filed: Jan. 27, 1986

[51] Int. Cl.[4] ..... A47B 3/06

[52] U.S. Cl. ..... 108/157; 108/159; 312/195

[58] Field of Search ..... 108/159, 157, 111, 153; 312/195

[56] References Cited

U.S. PATENT DOCUMENTS

| | | | |
|---|---|---|---|
| 1,395,166 | 10/1921 | Tomlinson | 108/157 |
| 1,645,336 | 10/1927 | McGlothern | 108/159 |
| 1,776,071 | 9/1930 | Horwath | 108/157 |
| 2,174,679 | 10/1939 | Zinser | 108/157 |
| 3,807,823 | 4/1974 | Rouse | 108/157 X |
| 3,871,726 | 3/1975 | Stegner | 312/195 |
| 4,021,087 | 5/1977 | Ferguson | 312/195 |

*Primary Examiner*—Francis K. Zugel
*Attorney, Agent, or Firm*—Daniel J. O'Connor

[57] ABSTRACT

An executive desk kit apparatus and method of assembly wherein all of the major desk components are fabricated of a layered corrugated fiberboard material. The material is factory pre-formed in a unique engineering design which permits rapid assembly by consumers unskilled in the furniture arts.

Each of the component desk parts are specifically designed to be shipped in a flat or knockdown position to reduce shipping and warehousing costs.

The pedestal stabilizers are interfitted with the desk pedestals by means of a novel flap, slot and groove configuration. The desk top is attached to the pedestals by means of integral flaps formed in the top.

9 Claims, 1 Drawing Figure

EXECUTIVE DESK WITH LOCKING FLAPS

Figure 1:
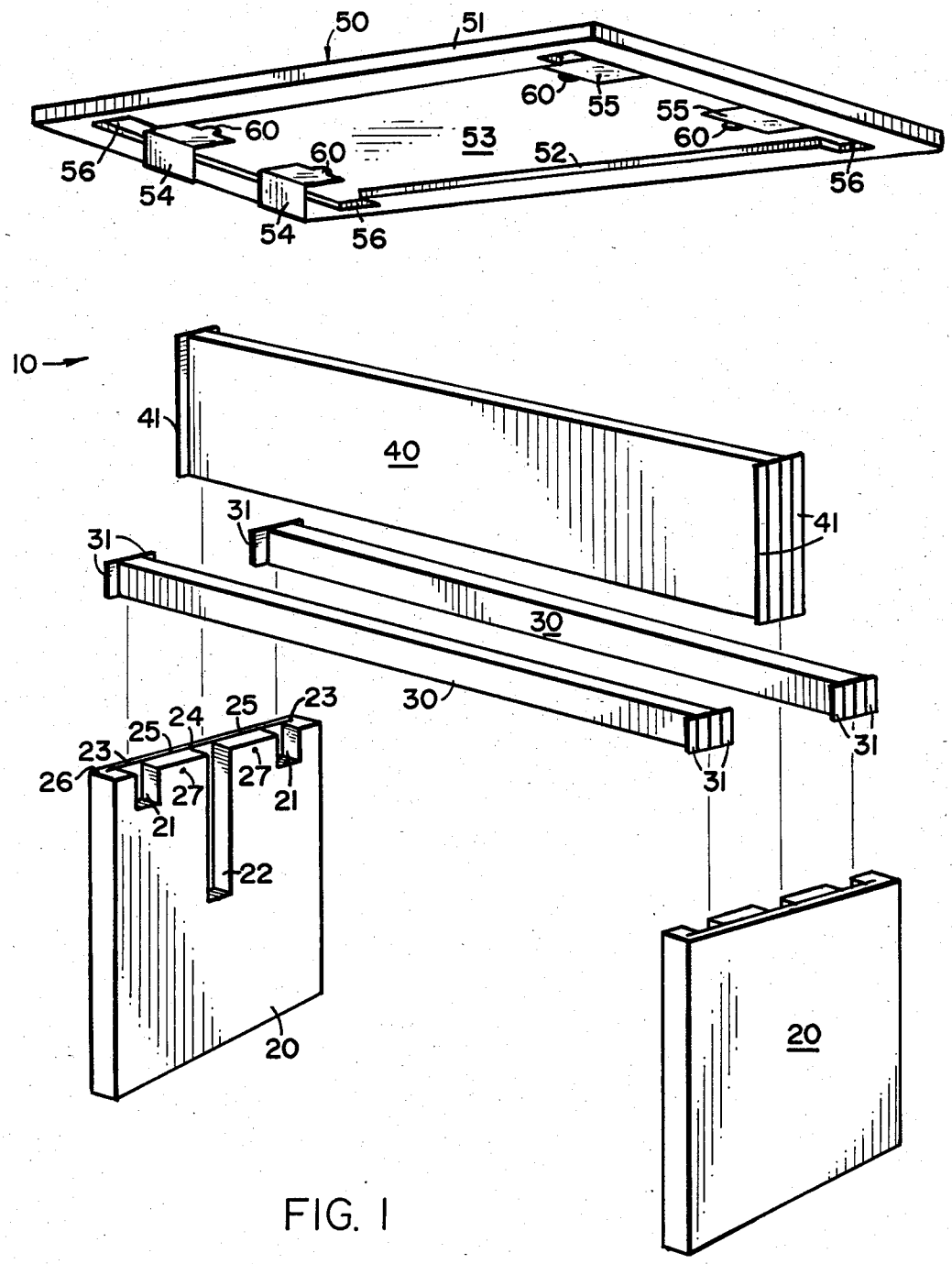

Papers relating to the present invention were previously filed under the Disclosure Document program of the U.S. Patent Office.

BACKGROUND OF THE INVENTION

This invention relates generally to an executive desk wherein all of the major component parts are formed entirely of layered corrugated fiberboard material.

The principles set forth herein could, however, be applied to any size desk, table or other related furniture item.

The use of knockdown desk furniture is known in the prior art as illustrated by the following patents: U.S. Pat. No. 1,949,913 issued to Larkin; U.S. Pat. No. 3,729,244 issued to Butler; U.S. Pat. No. 2,609,264 issued to Poe; and U.S. Pat. No. 2,987,362 issued to Bernath.

The patents of Poe and Bernath illustrate the relatively complex fastening devices required in prior art systems. Besides being costly to manufacture, such fastening means have also proven to be difficult to use by persons unskilled in furniture assembly techniques. Further, the sharp edges used in prior art fastening systems are a potential source of injury in this age of increasing products liability litigation.

The patents of Larkin and Butler (U.S. Pat. No. 1,949,913 and U.S. Pat. No. 3,729,244) illustrate knockdown desk furniture items made of bendable materials for assembly.

Larkin and Butler also require relatively complex assembly techniques which have heretofore resulted in a low sales volume for such furniture items.

The Larkin and Butler patents further illustrate the relative instability of assembled furniture items made of flexible materials currently on the market. Thus, all paperboard desk style furniture of the prior art has low load-bearing capabilities. Further, such prior art systems do not have a durable overall appearance.

OBJECTS OF THE INVENTION

Accordingly, it is an object of the present invention to provide a desk furniture kit in which all component parts are made of light weight corrugated fiberboard materials which are factory pre-formed and pre-cut in a manner to yield ease of assembly and a durable end product in function and appearance.

It is a further object of the present invention to provide a desk assembly kit in which the component parts thereof are interfitted in a highly stable manner and wherein a minimal number of separate fastening means are required.

It is a further object to provide a desk kit in which all component parts may be shipped in a flat or knockdown position to reduce shipping and warehousing costs.

Further objects and advantages of the present invention will become apparent as the following description proceeds, and the features of novelty characterizing the invention will be pointed out with particularity in the claims annexed to and forming a part of this specification.

BRIEF SUMMARY OF THE INVENTION

Desk pedestal means are factory pre-formed of layers of corrugated fiberboard material. By factory cutting particular layers of the pedestal material a slot and groove structure is formed as an integral part of the pedestal means. Pedestal stabilizers, which have bendable flaps at the ends thereof, may then be easily installed into the pedestal means with no separate fasteners required. Thus, a highly stable base is formed.

The desk top means is also formed of multiple layers of factory pre-glued corrugated fiberboard material. By factory cutting of the lower layers of the desk top, a recessed area is formed which is sized so as to fit over the base assembly formed by the pedestal means and the interfitted pedestal stabilizers. As will be further described, a middle layer of the desk top, comprising single wall corrugated fiberboard, has flap means factory formed therein. These flap means are easily placed in slots of the pedestal which are extensions of the slots previously referred to for receiving the pedestal stabilizer assemblies.

The top may then be securely fastened to the pedestal means via bolt holes formed in the pedestal.

Thus, a durable and attractive desk piece is made of low cost materials which are factory engineered for ease of assembly by the consumer.

BRIEF DESCRIPTION OF THE DRAWING FIGURE

The single drawing FIG. 1. shows the desk component parts in exploded isometric view to best illustrate the structure of said parts and the method of assembly of the present invention.

FULL DESCRIPTION OF THE PREFERRED EMBODIMENT

Referring now to the drawing FIG. 1, the executive desk 10 of the present invention is shown.

The desk 10 has two lower pedestals 20. Each pedestal comprises plural layers of corrugated fiberboard panels which have been factory pre-cut and pre-glued so as to require minimal assembly work by the purchaser.

From inside to outside, each pedestal 20 is comprised of the following construction:

One wrapping layer (inner).
Three layers of double wall corrugated fiberboard,
One layer of single wall corrugated fiberboard,
One layer of double wall corrugated fiberboard,
One wrapping layer (outer).

It is noted that the inner and outer wrapping layers listed above would normally be formed of one continuous sheet of fiberboard material having a vinyl coating layer factory applied thereto.

As shown in the drawing, three vertical grooves 21 and 22 are formed in each of the pedestals 20, said grooves being made by appropriately sized cuts in the inner wrap layer and the three inner layers of double wall corrugated fiberboard.

Slots 23 and 24 are also formed in the one layer of single wall corrugated fiberboard.

The grooves and slots aforementioned are for receipt of the three horizontal pedestal stabilizers 30 and 40 which have respective flaps 31 and 41 formed thereon. The stabilizers 30 and 40 are formed in a unique assembly construction for which a related patent application has been filed.

Once the horizontal pedestal stabilizers have been inserted, the desk top 50 may be attached to the unit.

The desk top 50 is comprised of the following layers from top to bottom:

One wrapping layer (upper),

Two layers of double wall corrugated fiberboard,

One layer of single wall corrugated fiberboard,

Two layers of double wall corrugated fiberboard (lower),

A partial inner wrapping layer (lower).

The two lower layers of double corrugated fiberboard have appropriately sized cuts 52 and 56 formed therein so as to allow the desk top 50 to rest on the corners 26 formed on the lower pedestals 20. As a result of said cuts, a central recessed ares 53 exists on the lower portion of the desk top 50.

Flaps 54, which are opened via grasping apertures 60, are formed in the layer of single wall corrugated fiberboard. It is to be understood that flaps 54 are placed in slots 25 of the lower pedestals 20, said slots 25 being formed as extensions of the previously referred to slots 23 and 24.

Once in position, the top 50 is simply pushed down onto the pedestals 20 and the flaps 54 may be locked to the pedestals via bolt holes 27.

The resulting desk assembly is highly durable, due to the built-up layers of corrugated fiberboard, while retaining the light weight characteristics of such material.

It may also be observed that the desk components can be shipped in a flat position to reduce shipping volume requirements, hence resulting in a lower cost desk unit for the consumer.

When sold in kit form, as is contemplated, the desk is easily assembled by the user with no complex assembly procedures as are required for most larger knockdown furniture items.

While corrugated fiberboard is the highly preferred material of use in the present invention, it will be seen that the principles set forth herein have application with a wide variety of other materials and it is intended to cover all such other material uses.

While the specific corrugated fiberboard layers for the desk top and pedestals have been named herein, it is intended to cover all variations of such layered construction which fall within the true spirit and scope of the present invention.

While there has been illustrated and described what is at present considered to be a preferred embodiment of the present invention it will be appreciated that numerous changes and modifications are likely to occur to those skilled in the art, and it is intended in the appended claims to cover all those changes and modifications which fall within the true spirit and scope of the present invention.

I claim:

1. An executive desk kit assembly wherein said kit comprises:

pedestal means (20) being fabricated of a multiple layer corrugated fiberboard material, said pedestal means (20) having a plurality of vertical groove means (21, 22) factory formed therein, said pedestal means (20) further having a plurality of open slot means (23, 24, 25) formed at a top surface thereof, wherein said executive desk kit further includes pedestal stabilizer means (30, 40), said pedestal stabilizer means having flap means (31, 41) formed at the ends thereof for slidable receipt into the slot means (23, 24) of the pedestal means (20) whereby the body portion of said pedestal stabilizer means (30, 40) is received in the vertical groove means (21, 22), said executive desk kit further including a top means (50), said top means (50) being comprised of multiple factory pre-cut layers of corrugated fiberboard, wherein at least one lower layer of said top means (50) has recessed area portions (53, 56) factory formed therein for fitting securely onto the lower desk base formed by said pedestal means (20) and said pedestal stabilizer means (30, 40), wherein one layer of said top means (50) has flap means (54) formed therein for folding into position for receipt by said slot means (25) of said pedestal means (20).

2. The executive desk kit of claim 1 wherein said groove means (21, 22) of the pedestal means (20) comprise two shortened grooves (21) and a central elongated groove (22).

3. The apparatus of claim 2 wherein said pedestal stabilizer means (30, 40) comprises two smaller pedestal stabilizers (30) for receipt in said shortened grooves (21) and a single larger pedestal stabilizer (40) for receipt in said central elongated groove.

4. The apparatus of claim 3 wherein all of said slot means (23, 24, 25) are formed in the same layer of the pedestal means (20).

5. The apparatus of claim 4 wherein said recessed area portions (53, 56) of said top means (50) form a T-shape (56) at either end thereof.

6. The apparatus of claim 5 wherein the layer of said top means (50) having flap means (54) formed therein also has aperture means (60) formed therein to allow manually grasping and outward folding of said flap means (54) for insertion in said slot means (25), whereby said top means (50) may be shipped in a flat position and said flap means (54) opened upon assembly of the executive desk kit.

7. The apparatus of claim 6 wherein said pedestal means (20) has bolt hole means (27) formed therein to allow fastening of said top flap means (54) securely into said slot means (25).

8. The apparatus of claim 7 wherein all of said component parts of the executive desk kit are comprised of corrugated fiberboard material.

9. A method of assembling an executive desk kit including pedestal means (20) having vertical groove means (21, 22) and slot means (23, 24, 25) formed therein, said desk kit further including pedestal stabilizer means (30, 40) having flap means (31, 41) formed at the ends thereof, said desk kit further including a top means (50) having flap means (54) formed on a lower surface thereof, wherein said method of assembly includes the steps of:

a. positioning said pedestal stabilizer means (30, 40) into interfitting relationship with said vertical groove means (21, 22) and said slot means (23, 24) to form a desk base, b. positioning said top means (50) over said formed desk base so that top flap means (54) are inserted into a portion of said slot means (25), c. bolting or otherwise securing said pedestal means (20) to said top means (50) by use of said top flap means (54).

* * * * *